US005590551A

United States Patent [19]

Hong

[11] Patent Number: 5,590,551

[45] Date of Patent: Jan. 7, 1997

[54] WASHING MACHINE EQUIPPED WITH BUBBLE PRODUCING APPARATUS AND BUBBLE PRODUCING CONTROL METHOD THEREOF

[75] Inventor: Seog J. Hong, Seoul, Rep. of Korea

[73] Assignee: LG Electronics Inc., Rep. of Korea

[21] Appl. No.: 423,534

[22] Filed: Apr. 17, 1995

[30] Foreign Application Priority Data

Apr. 16, 1994 [KR] Rep. of Korea ..... 8037/1994
Jun. 2, 1994 [KR] Rep. of Korea ..... 12436/1994

[51] Int. Cl.[6] ..... D06F 17/00

[52] U.S. Cl. ..... 68/183; 261/76; 261/DIG. 75

[58] Field of Search ..... 68/183; 261/DIG. 75, 261/76

[56] References Cited

U.S. PATENT DOCUMENTS

| | | | |
|---|---|---|---|
| 1,768,702 | 7/1930 | Martin | 68/183 X |
| 2,453,620 | 11/1948 | Cathey et al. | 68/183 |
| 4,936,689 | 6/1990 | Federighi et al. | 366/337 |
| 5,167,798 | 12/1992 | Yoon et al. | 209/170 |

FOREIGN PATENT DOCUMENTS

| | | | |
|---|---|---|---|
| 1058156 | 11/1953 | France | 68/183 |
| 594594 | 3/1934 | Germany | 68/183 |
| 536985 | 12/1955 | Italy | 68/183 |
| 232581 | 12/1984 | Japan | 68/183 |
| 12796 | 1/1992 | Japan | 68/183 |
| 586528 | 3/1947 | United Kingdom | 68/183 |

*Primary Examiner*—Philip R. Coe
*Attorney, Agent, or Firm*—Ostrolenk, Faber, Gerb & Soffen, LLP

[57] ABSTRACT

An improved washing machine equipped with a bubble producing apparatus and a bubble producing control method thereof capable of advantageously reducing the needed amount of detergents and preventing laundry from being damaged and entangled. The washing machine includes a washing machine body; an outer tub disposed inside the washing machine body for receiving detergent-containing water therein; an inner tub disposed inside the outer tub for receiving detergent-containing water and laundry therein and having a plurality of water drain holes formed on the circumferential surface thereof; and a bubble producing apparatus disposed on the bottom of the outer tub for producing bubbles. In addition, there is provided a bubble producing control method for a washing machine equipped with a bubble producing apparatus, which includes a first step which drives a drive motor clockwise and counterclockwise; a second step which computes and compares the number of pulses outputted in accordance with the amount of laundry to be washed so as to compute the amount of laundry in the inner tub; a third step which enters a wash cycle for a predetermined time in accordance with the amount of laundry; a fourth step which performs a normal washing mode in accordance with the number of the pulses; and a fifth, step which sets a detergent-containing circulation and a circulation time in accordance with the amount of laundry.

5 Claims, 5 Drawing Sheets

WASHING MACHINE EQUIPPED WITH BUBBLE PRODUCING APPARATUS AND BUBBLE PRODUCING CONTROL METHOD THEREOF

BACKGROUND OF THE INVENTION

1. Field of the Invention

The present invention relates to a washing machine equipped with a bubble producing apparatus and a bubble producing control method thereof, and particularly to an improved washing machine equipped with a bubble producing apparatus and a bubble producing control method thereof capable of advantageously reducing the using mount of detergents and preventing laundry from damages and tangles.

2. Description of the Conventional Art

Referring to FIG. 1, there is provided a washing machine having a generally upstanding rectangular block washing machine body 10. The washing machine body 10 is provide with an outer tub 20 disposed inside the washing machine body 10 and charged with a detergent-contained water in accordance with a predetermined operation mode. Each upper end of a pair of elongated bar 30 each having an enforced fixing member 30*a* formed on each of the lower ends thereof is fixed to a predetermined portion of the upper portion of the washing machine body 10, and each lower end thereof, the enforced fixing members 30*a*, is fixed to a predetermined portion of the outer circumferential surface of the outer tub 20. An inner tub 40 is disposed inside the outer tub 20, and thus forming a predetermined space between the inner circumferential surface of the outer tub 20 and the outer circumferential surface of the inner tub 40.

In addition, a plurality of vertically spaced-apart water drain hole supporting protrusions 40*a* are formed on the inner circumferential surface of the inner tub 40. Here, a plurality of water drain holes 40*a'* are formed on the water drain hole supporting protrusions 40*a* and the bottom of the inner tub 40, which is directed to permit the detergent-contained water, except for the laundry, to flow freely between the outer tub 20 and the inner tub 40.

Meanwhile, on the bottom of the inner tub 40 is disposed a rotary member 50 fixed to the upper end of a clutch shaft 60 extended through a shaft opening 40*b* formed on the central portion of the bottom of the inner tub 40 and consisting of a plurality of blades for rotating the detergent-contained water and the laundry in the inner tub 40 clockwise or counterclockwise in accordance with a predetermined operation mode. Here, the lower end of the clutch shaft 60 is connected to a predetermined portion of a clutch 70 which is adapted to convert a predetermined rotation force applied thereto into a clockwise or counterclockwise rotation force. On the lower end of the clutch 70 is fixedly disposed a clutch pulley 80.

Meanwhile, a motor 90 is disposed on a predetermined portion of the outer bottom of the outer tub 20 and spaced apart from the clutch 70 and have a downwardly extending motor shaft 90*a*. A motor pulley 100 is disposed on the end of the motor shaft 90*a*. Here, a belt 110 is connected between the clutch pulley 80 and the motor pulley 100, whereby a predetermined force produced from the motor 90 is transferred to the rotary member 50 through the motor pulley 100, the belt 110, the clutch pulley 80, and the clutch 70.

Meanwhile, an air supply member 120 having a motor (not shown) disposed therein is disposed on a predetermined portion of the upper portion of the washing machine body 10. A sponge-like bubble producing member 140 is disposed on the inner upper surface of the bottom of the outer tub 20. Here, an air tube 130 is connected between the air supply member 120 and the bubble producing member 140. In addition, a water drain conduit 150 having a valve 160 for controlling a drain operation in accordance with a predetermined operational mode is disposed below the outer tub 20, one end of which is connected to a predetermined portion of the bottom of the outer tub 20, and the other end thereof is extended to the outside of the washing machine body 10.

The operation of a conventional washing machine equipped with a bubble producing apparatus will now be explained with reference to FIG. 1.

To begin with, a user pushes a power button and then selects a predetermined operational mode in accordance with a kind of laundry. A predetermined amount of laundry is filled in the inner tub 40, and a predetermined amount of a detergent-contained water is charged in the outer tub 20 and the inner tub 40 in accordance with a predetermined operational mode which is selected by the user. Thereafter, the motor 90 produces a predetermined rotation force transferred to the clutch 70. Here, the clutch 70 converts the rotation force applied thereto into a clockwise or counterclockwise rotation force for permitting the rotary member 50 to rotate thereto and thus rotating the detergent-contained water and laundry in the inner tub 40, thereby producing a predetermined rotation force that is, eccentrically absorbing force, in the central portion of the detergent-contained water.

At this time, the air supply member 120 runs in a predetermined operational mode for producing a predetermined amount of air and forcibly blowing the air into the air conduit 130, and the air flows to the bubble producing member 140. Thereafter, the bubble producing member 140 produces a plurality of bubbles of a relatively big size and uneven in their diameter, and the bubbles gather in the outer tub 40 and flow toward the inner tub 40 through the plurality of water drain holes 40*a'* formed on the side wall and the bottom wall of the inner tub 40 by a predetermined rotation force of the detergent-contained water and laundry in the inner tub 40.

In the detergent-contained water in the inner tub 40, there are already contained various kinds of foreign objects by means of detergent such as oil, particles of laundry, dusts, soils, etc., which have almost small size. In such states, such foreign objects are attached to the outer circumferential surface of each bubble and then drained toward the outside of the washing machine body 10 of washing machines in accordance with a predetermined operational mode.

However, a conventional washing machine equipped with a bubble producing apparatus has disadvantages that each bubble produced thereby has a uneven and relatively big diameter, thereby washing effects are poor that is, dirties such as stains of laundry were removed unevenly. In addition, the bubbles are easily merged to make a more big size one, thereby absorbing the detergent components in the detergent-contained water and going up to the water surface. In addition, a total surface of the circumferential surface of the bubbles are relatively low rather than microbubbles, so that the washing performance is lowered. To overcome the problems, if the user increase the amount of detergent, it may be blame for the increased washing cost and water pollution.

SUMMARY OF THE INVENTION

Accordingly, it is an object of the present invention to provide a washing machine equipped with a bubble producing apparatus and a bubble producing control method thereof which does not involve problems encountered in a conventional washing machine equipped with a bubble producing apparatus.

It is another object of the present invention to provide an improved washing machine equipped with a bubble producing apparatus and a bubble producing control method thereof capable of advantageously reducing the using amount of detergents and preventing laundry from damages and tangles.

To achieve the above objects, there is provided a washing machine equipped with a bubble producing apparatus, which includes a washing machine body of a washing machine; an outer tub disposed inside the washing machine body for receiving a detergent-contained water therein; an inner tub disposed inside the outer tub for receiving a detergent-contained water and laundry therein and having a plurality of water drain holes formed on circumferential surface thereof; and a bubble producing apparatus disposed on the bottom of the outer tub for producing a plurality of bubbles.

In addition, there is provided a bubble producing control method of a washing machine equipped with a bubble producing apparatus, which includes the steps of a first step which drives a drive motor clockwise and counterclockwise; a second step which computes and compares the number of pulse outputted in accordance with the amount of laundry to be washed so as to compute the amount of laundry in a inner tub; a third step which washes for a predetermined time in a accordance with the amount of laundry; a fourth step which performs a normal washing mode in accordance with the number of the pulse; and a fifth step which set a detergent-contained circulation and a circulation time in accordance with the amount of laundry.

DETAILED DESCRIPTION OF THE INVENTION

The description of a bubble producing apparatus of a washing machine and a bubble producing control method thereof according to the present invention will now be provided.

Figure 1:
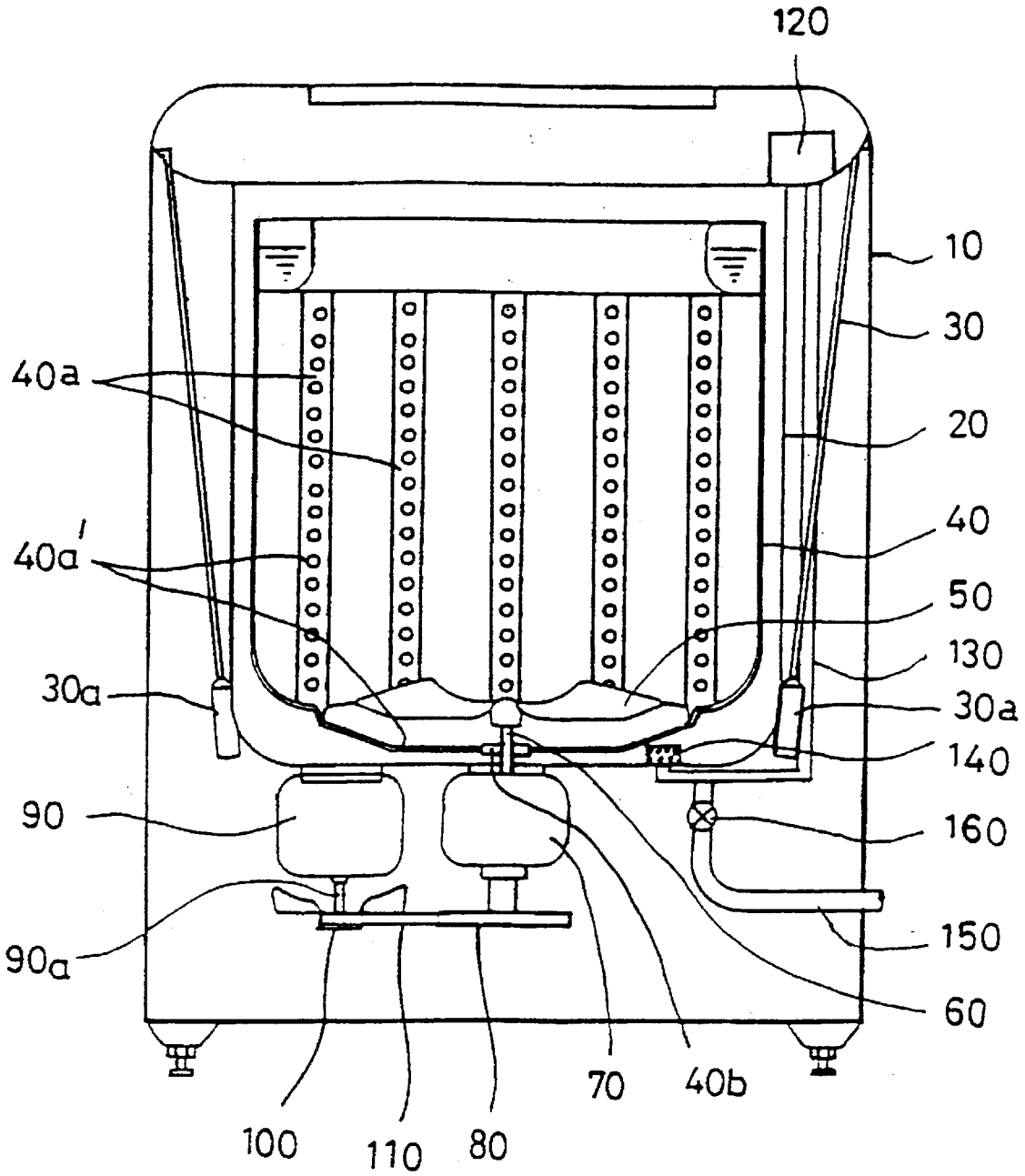
FIG. 1 CONVENTIONAL ART
FIG. 1 is a cross-sectional view showing a washing machine equipped with a conventional bubble producing apparatus.
Figure 2:
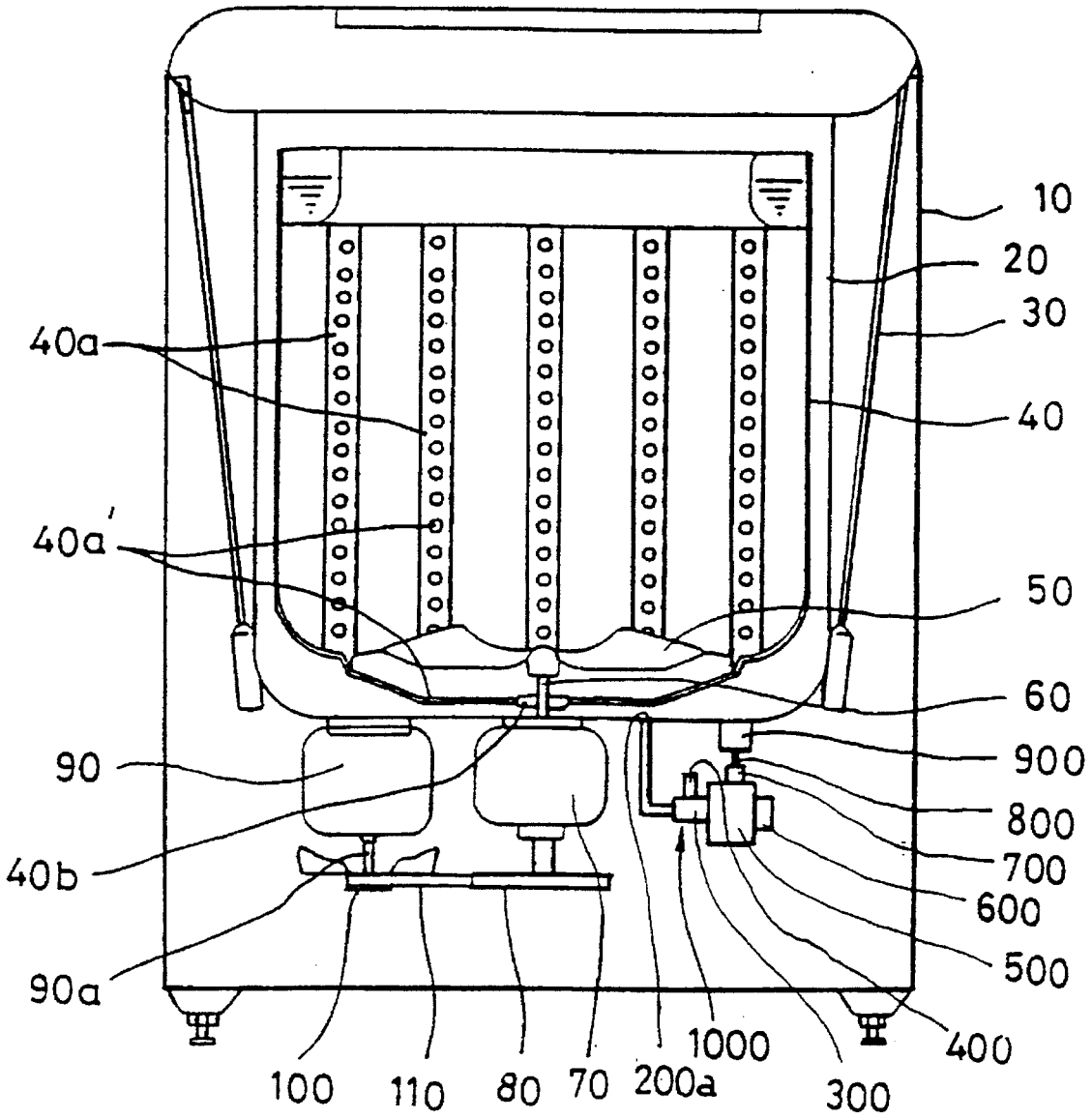
FIG. 2 is a cross-sectional view showing a washing machine equipped with a bubble producing apparatus according to the present invention.
Figure 3:
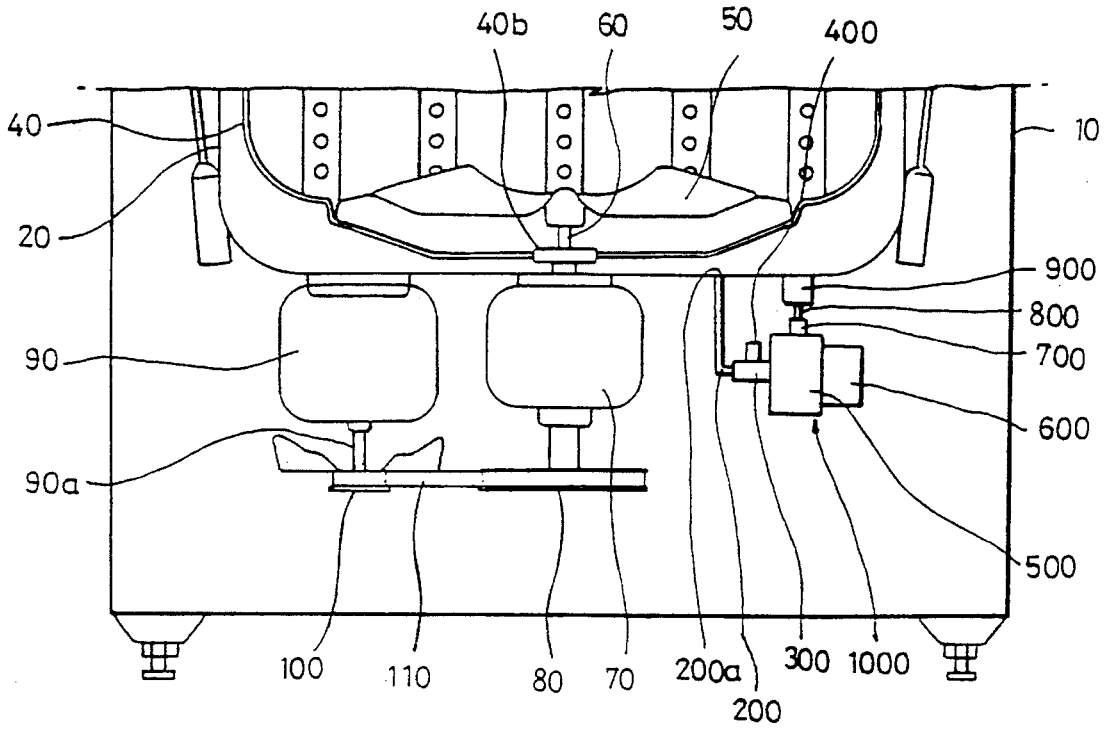
FIG. 3 is a cross-sectional view showing a bubble producing apparatus of a washing machine of FIG. 1 according to the present invention.

Referring to FIGS. 2 and 3, a bubble producing apparatus 1000 according to the present invention is disposed on a predetermined portion of the bottom of the outer tub 20.

Here, the bubble producing apparatus 1000 is provided with a detergent-contained water guide tube 200, one end of which is connected to a detergent-contained water guide tube hole 200*a* formed on a predetermined portion of the bottom of the outer tub 20, and the other end of which is connected to one end of an suction tube 300 having an upwardly extending air suction port 400 formed on the outer circumferential surface thereof for inhale air therethrough. The other end of the suction tube 300 is fixed to a pump 500, which is adapted to pump the detergent-contained water in the outer tub 20 toward the pump 500. A motor 600 is provided on a predetermined portion of the circumferential surface of the pump 500. Here, an upwardly extending exhausting tube 700 is disposed on a predetermined portion of the pump 500, the upper end of which is connected to the lower end of a detergent-contained water suction tube 800, while the upper end of which is connected to the bottom of a vertically elongated mixer 900 having a bubble supply opening 820 formed on the upper portion thereof. Here, the mixer 900 is adapted to convert the detergent- and air-contained water transferred from the outer tub 20 through the detergent-contained water guide tube 200, the pump 500, and the exhausting tube 700 into the detergent- and microbubble-contained water. Here, the top of the mixer 900 is connected to the bottom of the outer tub 20.

Figure 4:
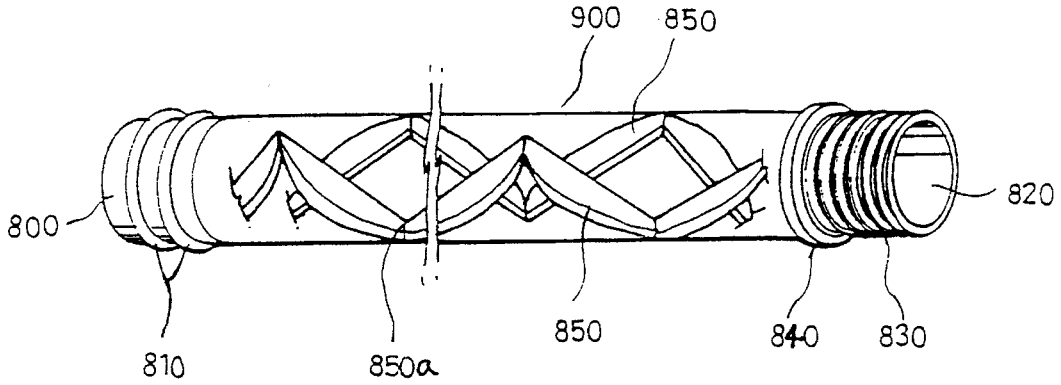
FIG. 4 is a cross-sectional view showing a mixer of a bubble producing apparatus of a washing machine according to a first embodiment of the present invention.

The construction of the mixer 900 according to a first embodiment of the present invention will be explained in more detail below with reference to FIG. 4.

To begin with, a pair of spaced-apart protrusions 810 are formed on the circumferential surface of the lower end of the mixer 900 for detachably engaging with the upper end of the detergent-contained water suction tube 800. A thread portion 830 is formed on the upper end of the mixer 900, so that the mixer 900 is threadly fixed to the bottom of the outer tub 20. A protrusion 840 is formed on the circumferential surface of the upper end of the mixer for limiting the engagement between the upper portion of the mixer 900 and the bottom of the outer tub 20.

Inside the mixer 900, there are provided a plurality of vanes 850 linked one another by a plurality of vane joints 850*a*.

Figure 5:
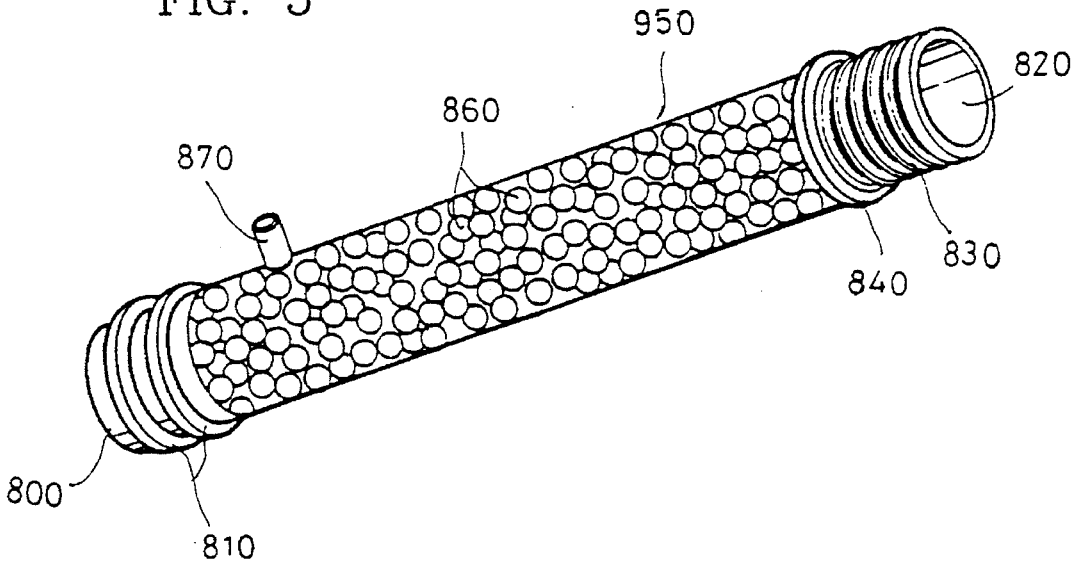
FIG. 5 is a cross-sectional view showing a mixer of a bubble producing apparatus of a washing machine according to a second embodiment of the present invention.

Referring to FIG. 5, there is shown a mixer 950 according to a second embodiment of the present invention.

The same reference numerals are given to the elements which have the same construction as in the first embodiment of the mixer 900 of the bubble producing apparatus 1000 according to the present invention. In addition, the description is omitted for the same construction.

Inside the mixer 950, there is filled with a plurality of balls 860 having a predetermined diameter for forming a predetermined gap between the balls 860, so that the detergent- and air-contained water is converted into the detergent- and microbubble-contained water in the same manner of the first embodiment of the mixer 900.

Meanwhile, being different from the first embodiment of the mixer 900, there is provided an horizontal air suction port 870 formed on the circumferential surface of the mixer 950 for inhaling the air therethrough. The air suction port 400 shown in FIGS. 2 and 3 is required in the second embodiment of the mixer 950.

Figure 6:
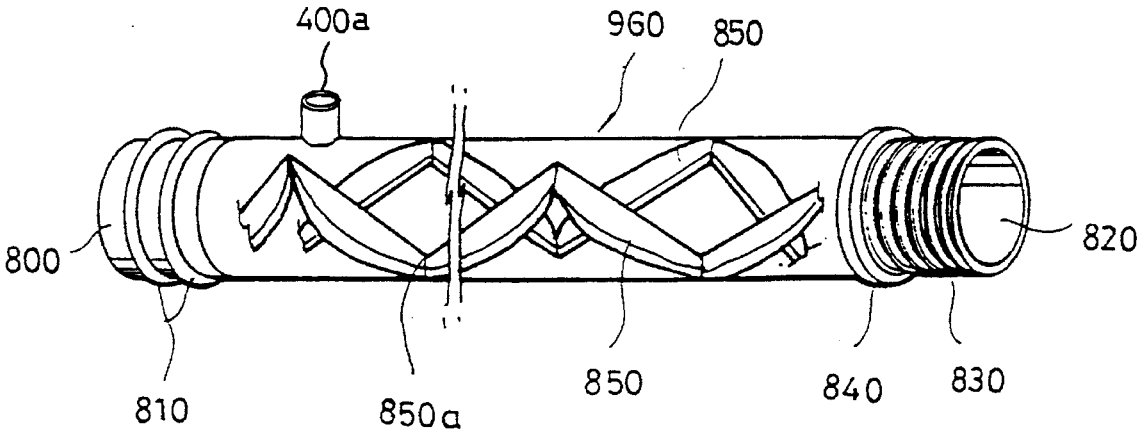
FIG. 6 is a cross-sectional view showing a mixer of a bubble producing apparatus of a washing machine according to a third embodiment of the present invention.
Figure 7:
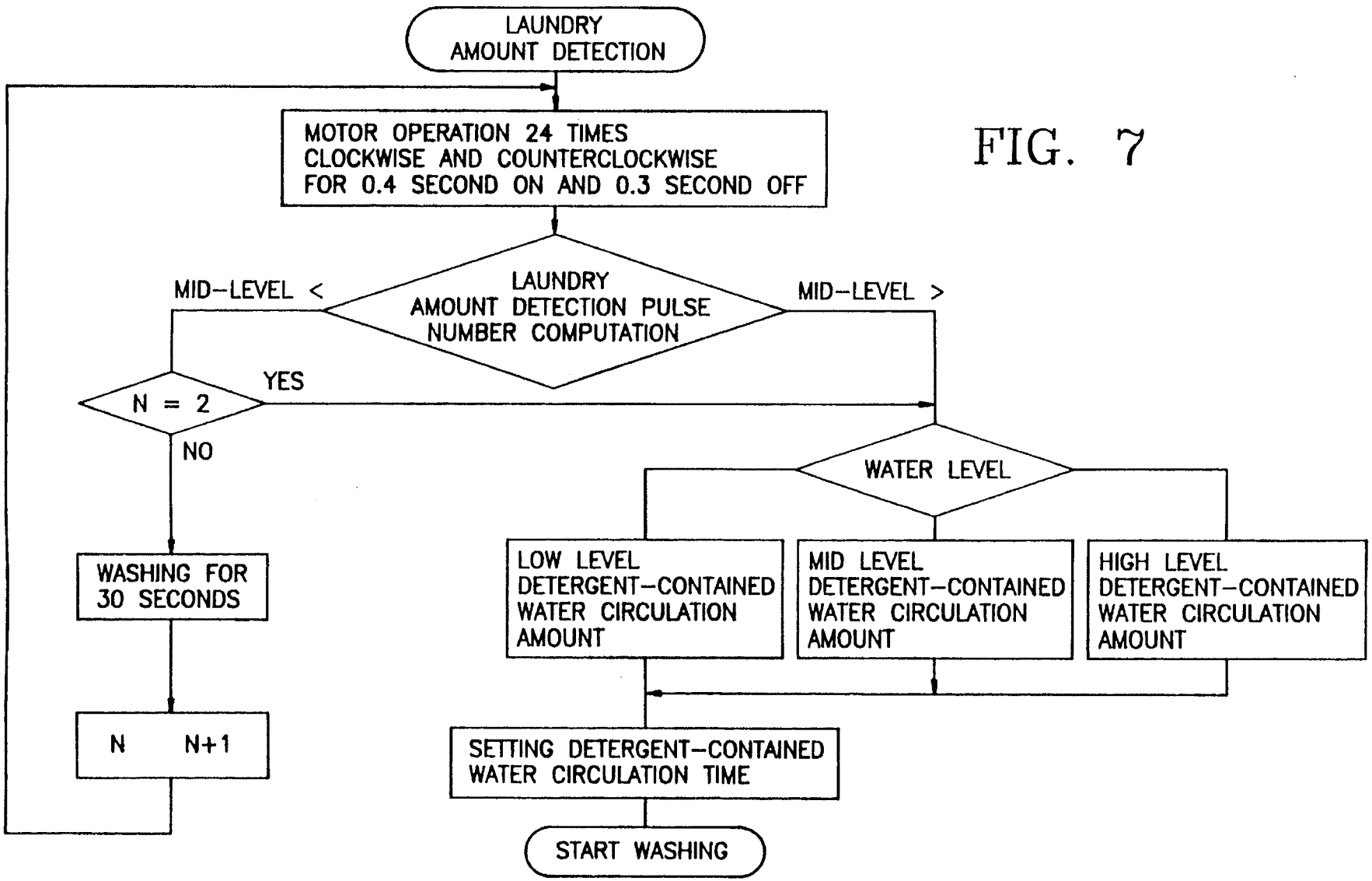
FIG. 7 is a flow chart showing a method of controlling the amount of producing bubbles by controlling the circulation amount and the circulation time of detergent-contained water by detecting the amount of washing before starting washing according to the present invention.

Referring to FIG. 6, there is shown a mixer 960 according to a third embodiment the present invention.

The third embodiment of the mixer has the same construction as the mixer 900 of the second embodiment except that the mixer 960 of the third embodiment has an air suction member 400*a* formed on a predetermined portion of the circumferential surface of the mixer 960 and has the same reference numerals as in the first embodiment except the air suction member 400*a*. In addition, in the construction of the bubble producing apparatus 1000, the air suction port 400 of FIG. 3 is not provided. Here, the air is supplied into the mixer 960 through the air suction member 400*a* by an air supply device (not shown) mounted on a predetermined portion of the washing machine body 10 of FIG. 2.

The operation of a washing machine equipped with a bubble producing apparatus will now be explained with reference to FIGS. 2 through 6.

To begin with, the inner tub 40 is charged with laundry and detergent-contained water. The outer tub 20 is charged with detergent-contained water. In the above state, a user pushes a power button and selects a predetermined mode. Thereafter, the motor 600 runs, and the washing machine starts operating in accordance with a selected operational mode. At this time, the motor 600 runs to facilitate the pump 500 to suck the detergent-contained water in the outer tub 20 through the detergent-contained water guide tube 200 and the air from the air suction port 400. In the pump 500, the air and detergent-contained water coexist.

As the detergent- and air-contained water transmitted from the pump 500 advance toward sharp edges of each vane 850, the air, having larger volume, is mixed into the detergent-contained water, producing a plurality of small-sized bubbles. In addition, at nearly ending portion of flowing of the detergent-contained and small-sized bubble-contained water inside the mixer 900 is converted into the detergent- and microbubble-contained water since the more they advance toward the upper end of the mixer 900, the more they are mixed while the volume of the air being divided into the more smaller bubble.

Thereafter, the microbubbles flow into the outer tub 20 and the inner tub 40. Here, the microbubbles forcibly flow into the inner tub 40 from the outer tub 20 through the plurality of the water drain holes 40*a'* by a predetermined rotation force in the inner tub 40 occurred when the detergent-contained water and laundry rotate therein.

In the inner tub 20, the microbubbles attach small-sized ingredients, separated from laundry by means of detergent, on its circumferential surface. And then, the ingredients attached on the microbubbles are drained to the outside of the washing machine in accordance with a predetermined operational mode.

Here, the diameter of a microbubble is measured through the following expression:

$$\frac{Db}{D} = A(We)^{-n}$$

Where Db is the diameter of a bubble, D is the diameter of a mixer, We is a constant number of Weber, and "A" and "N" each is a constant number.

With the above expression, the diameter of a microbubble can be advantageously variable by increasing or decreasing the diameter of mixers 900 and 950.

Meanwhile, FIG. 6 shows a flow chart of a method of controlling a circulation amount and circulation time of the detergent-contained water thereby correctly controlling the producing amount of microbubbles and thus the optimum washing performance can be obtained in accordance with a kind of laundry.

To begin with, a microcomputer (not shown) disposed on a predetermined portion of the washing machine body 10 facilities the drive motor 90 to rotate clockwise 0.4 second, to stop for 0.3 second and to rotate counterclockwise 0.4 second in order so as to detect the amount of the laundry charged in the inner tub 40 using a sensor (not shown) disposed on the a predetermined portion of the washing machine body 10. Here, the rotation operation "N" of the drive motor 90 is performed 24 times.

Thereafter, the microcomputer computes the amount of the laundry to be washed in accordance with a predetermined pulse outputted as a result of the rotation operation "N" of the drive motor 90. That is, if the predetermined pulse outputted therefrom is larger than a predetermined level, for example, a mid-level which is previously stored in the microcomputer, the washing machine performs a washing operation for 30 seconds after judging the number of the rotation number "N" is two and then feeds back to the initial state that is, the clockwise and counterclockwise rotation operation of the drive motor 90. If the predetermined pulse outputted therefrom is smaller than a predetermined level, for example, a mid-level which is previously stored in the microcomputer, the washing machine enters into a normal washing operation in accordance with a predetermined operational mode. At this time, the number of the feed back is limited by a routine "N=2." That is, if N is two, the operation of the washing machine is directed to enter into a normal operation.

Thereafter, the microcomputer judges whether the pulse is related to a low-level detergent-contained water circulation, a mid-level detergent-contained water circulation, or a high-level detergent-contained water circulation. As a result, the microcomputer judges a corresponding level of the detergent-contained water for controlling the drive motor 90 which is disposed to control the pump 500, so that the amount of the microbubbles can be controlled in accordance with a level of the power of the drive motor 90 in accordance with a kind of laundry.

As described above, a washing machine equipped with a bubble producing apparatus and a bubble producing control method thereof according to the present invention is directed to achieve a better washing performance by adapting a microbubble producing apparatus capable of significantly reducing the amount of using detergent and preventing tangles of laundry. In addition, since there are no needs to wash laundry for long time, so that electric power consumption will not be costly.

What is claimed is:

1. A washing machine equipped with a bubble producing apparatus, comprising:

a washing machine body;

an outer tub disposed inside said washing machine body for receiving detergent-containing water therein;

an inner tub disposed inside said outer tub for receiving said detergent-containing water and laundry therein and having a plurality of water drain holes formed in a circumferential surface thereof; and bubble producing means disposed on a bottom of the outer tube for producing a plurality of bubbles, wherein said bubble producing apparatus including;

a detergent-containing water guide tube, one end of which is connected to a portion of the outer tub;

a suction tube connected to another end of the detergent-containing water guide tube and having an air suction port formed on a circumferential surface thereof, said air suction port being directed to suck air therethrough;

a pump connected to the suction tube for sucking detergent-containing water from said detergent-containing water guide tube and air from said air suction port;

a motor disposed on a circumferential surface of the pump for providing said pump with a driving force;

a detergent-containing water suction tube, one end of which is connected to the pump; and a mixer connected between the bottom of the outer tub and said detergent-containing water suction tube for producing a plurality of microbubbles.

2. A washing machine equipped with a bubble producing apparatus, comprising:

a washing machine body;

an outer tub disposed inside said washing machine body for receiving detergent-containing water therein;

an inner tub disposed inside said outer tub for receiving said detergent-containing water and laundry therein and having a plurality of water drain holes formed in a circumferential surface thereof; and bubble producing means disposed on a bottom of the outer tub for producing a plurality of bubbles, said bubble producing apparatus including;

a detergent-containing water guide tube, one end of which is connected to a portion of the outer tub;

a suction tube connected to another end of said detergent-containing water guide tube;

a pump connected to the suction tube for sucking detergent-containing water from said detergent-containing water guide tube;

a motor coupled to the pump for providing said pump with a driving force;

a detergent-containing water suction tube, one end of which is connected to the pump;

a mixer connected between the bottom of the outer tub and said detergent-containing water suction tube for producing a plurality of microbubbles; and air suction means extending to the outside of said washing machine body for sucking air.

3. The washing machine of claim 2, wherein said air suction means is directed suck air forcibly.

4. The washing machine of claim 1, wherein said mixer includes a plurality of vane arrays, each of vane arrays having a plurality of vanes and each being connected by a vane joint.

5. The washing machine of claim 1, wherein said mixer includes a plurality of balls charged therein, each of which having a predetermined diameter.

* * * * *